US005379845A

United States Patent [19]

Blount et al.

[11] Patent Number: 5,379,845

[45] Date of Patent: Jan. 10, 1995

[54] METHOD FOR SETTING A WHIPSTOCK IN A WELLBORE

[75] Inventors: Curtis G. Blount, 251 Gail Drive, Wasilla, Ak. 99654; Charles D. Hailey, Oklahoma City, Okla.; Charles M. Hightower, Plano, Tex.

[73] Assignees: Atlantic Richfield Company, Los Angeles, Calif.; Curtis G. Blount, Wasilla, Ala. ; a part interest

[21] Appl. No.: 254,714

[22] Filed: Jun. 6, 1994

[51] Int. Cl.[6] ..... E21B 7/00

[52] U.S. Cl. ..... 166/382; 166/117.6; 175/61; 175/80; 175/81

[58] Field of Search ..... 166/382, 117.6, 117.5; 175/61, 79, 80, 81, 82

[56] References Cited

U.S. PATENT DOCUMENTS

| | | | |
|---|---|---|---|
| 1,951,638 | 3/1934 | Walker | 166/117.6 X |
| 2,132,061 | 10/1938 | Walker | 166/117.6 |
| 2,766,010 | 10/1956 | Hester | 166/117.6 |
| 3,095,039 | 6/1963 | Kinzbach | 166/117.6 |
| 4,307,780 | 12/1981 | Curington | 166/117.6 X |
| 4,606,410 | 8/1986 | Becker et al. | 166/117.5 X |
| 5,193,620 | 3/1993 | Braddick | 166/382 |
| 5,222,554 | 6/1993 | Blount et al. | 166/117.6 |
| 5,287,921 | 2/1994 | Blount et al. | 166/117.6 |

*Primary Examiner*—Hoang C. Dang
*Attorney, Agent, or Firm*—Roderick W. MacDonald

[57] ABSTRACT

A method for setting a whipstock in a wellbore on a packer-anchor which employs a wireline that carries a setting assembly which severs a shear member carried by the setting assembly after the whipstock is set onto the packer-anchor.

6 Claims, 1 Drawing Sheet

METHOD FOR SETTING A WHIPSTOCK IN A WELLBORE

BACKGROUND OF THE INVENTION

In subterranean well operations, it is necessary from time to time to set a whipstock in a sub-surface wellbore conduit such as a tubing string or a well casing. The whipstock is set to deviate a mill or a drill bit away from the longitudinal axis of the well conduit. A mill is often used to cut a window in the conduit through which to drill a deviated wellbore at an angle to the longitudinal axis of the conduit and original wellbore.

The whipstock is normally set in the wellbore by the use of a conventional (jointed straight) pipestring or coiled tubing, as fully and completely set forth in U.S. Pat. No. 5,287,921 to Blount, et al.

Setting a whipstock with a pipestring, whether conventional or coiled tubing, takes time and effort, particularly with conventional pipe whose individual lengths have to be connected together at the earth's surface with coupling means.

By this invention, the process of setting a whipstock in a wellbore is substantially speeded by employing a conventional wireline unit.

SUMMARY OF THE INVENTION

In accordance with this invention, a packer-anchor is first set in the wellbore in the vicinity where the whipstock is desired to be located. The wireline is provided with a setting assembly, which assembly carries the whipstock by means which includes a shear member. The setting assembly is passed into the wellbore by means of the wireline on the wireline unit until the whipstock mates with the packer anchor, at which time the setting assembly is actuated to provide an impact force to sever the shear member and otherwise separating the setting assembly from the whipstock. Thereafter, the wireline and setting assembly is removed from the wellbore, leaving the whipstock set onto the packer anchor.

Accordingly, it is an object of this invention to provide a new and improved method for setting a whipstock in a sub-surface well conduit.

It is another object to provide a new and improved method for employing a conventional electric wireline unit to set a whipstock in a wellbore.

Other aspects, objects and advantages of this invention will be apparent to those skilled in the art from this disclosure and the appended claims.

DETAILED DESCRIPTION OF A PREFERRED EMBODIMENT

Figure 1:
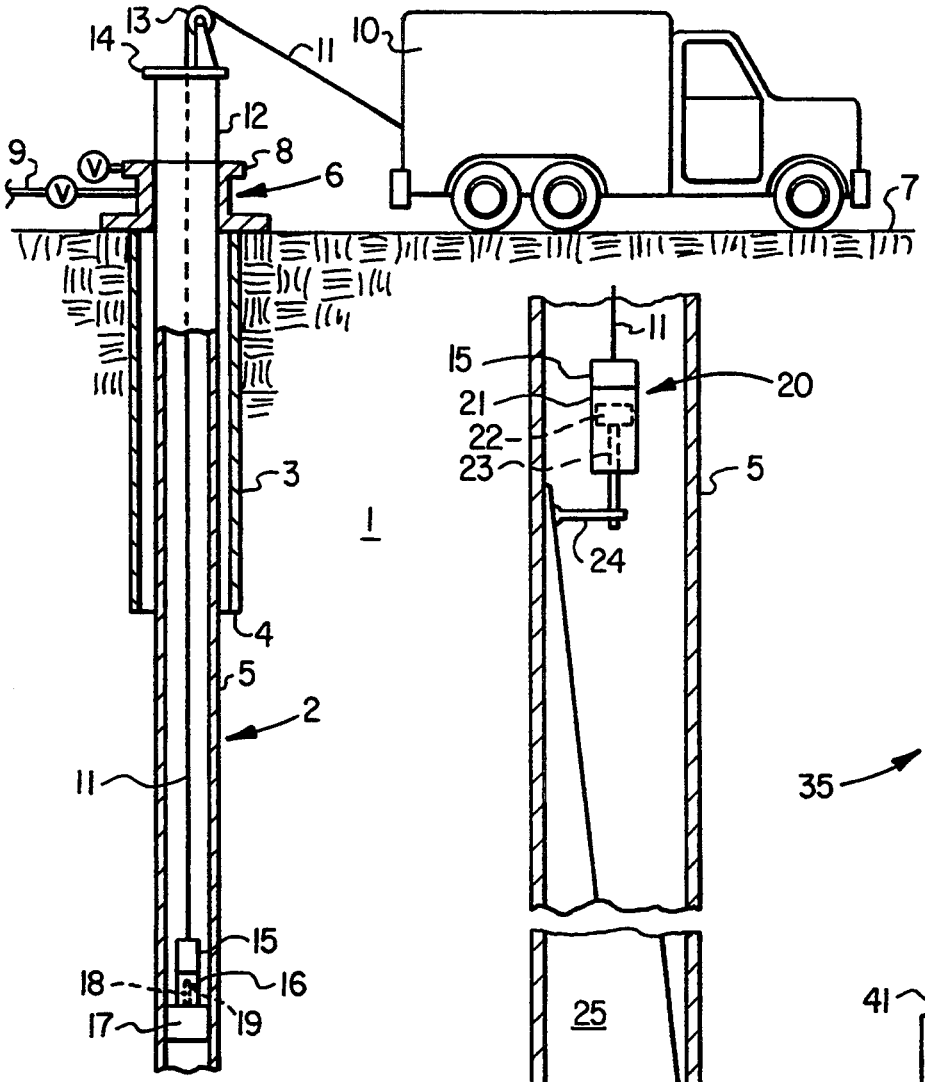
FIG. 1 shows a conventional electric wireline unit setup for setting a packer anchor in a wellbore.

More specifically, FIG. 1 shows the earth 1 having a wellbore 2 extending downwardly thereinto. Wellbore 2 is lined with surface casing 3 to a fixed depth 4. Wellbore 2 further contains casing 5 which extends from conventional wellhead 6 at earth's surface 7 down to a producing formation (not shown). Casing 5 extends into wellhead 6 which is surmounted by a conventional crown valve 8. Wellhead 6 carries valved conduit 9 from which oil, gas or other fluids produced from the producing formation pierced by casing 5 can be removed from the wellbore for treatment, storage, transportation, and the like.

Located on earth's surface 7 adjacent wellhead 6 is a conventional electric wireline unit 10 which carries a supply of electric wireline 11. Wellhead 6 is surmounted by a conventional lubricator 12 which carries a sheave wheel 13 over which wireline 11 passes when it enters lubricator 12 by way of stuffing box grease injector head or 14 for entry into the interior of wellbore 2 and casing 5.

In FIG. 1, wireline 11 is shown to be carrying a conventional cable head 15 which simply provides a connecting function for whatever apparatus is to be connected to and carried by wireline 11. Below cable head 15 there is provided a conventional electric wireline setting tool 16. Setting tool 16 carries a whipstock packer or packer-anchor 17. Packer 17 has rigidly fixed thereto upstanding stinger 18, stinger 18 being fixed to setting tool 16 in a conventional manner. Stinger 18 also carries orienting lug 19 for orienting the whipstock in the desired manner when the whipstock is set onto packer 17. Packer 17 can also be set with a single arm bow spring, magnet or similar orientation device plus a surface read out device to tell the operator if lug 19 is in a desirable position.

When packer 17 is lowered to the desired location along the length of casing 5, setting tool 16 is electrically actuated from wireline unit 10 by transmission of an electrical signal along wireline 11 to sever setting tool 16 from stinger 18 in a conventional manner. Setting tool 16 can be any basic wireline setting tool such as a Baker Model E-4 wireline pressure setting device. The anchor can then be checked with a conventional survey tool to determine the orientation of lug 19. The method, as thus far described, is known to the prior art and need not be described in greater detail to fully inform those skilled in the art.

Figure 2:
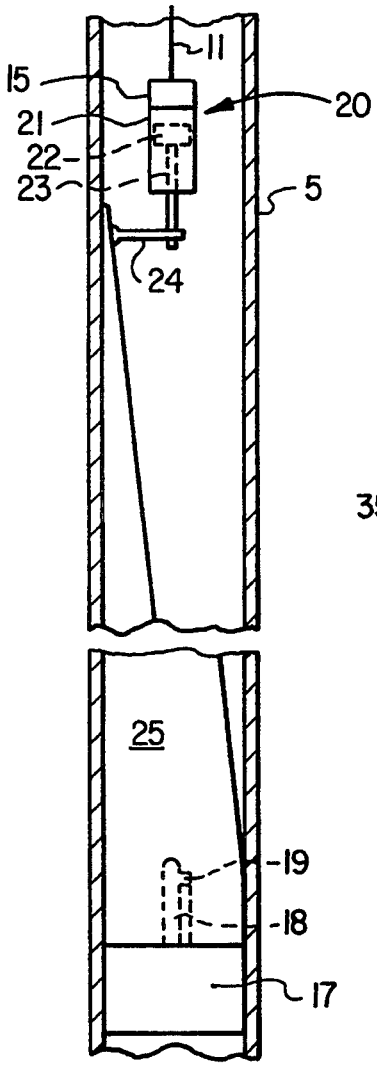
FIG. 2 shows one embodiment of apparatus useful in this invention which employs an electric wireline setting tool.

After packer 17 is set inside casing 5 in the manner described in FIG. 1, it is time to set a whipstock onto packer 17. In accordance with one embodiment of this invention, as shown in FIG. 2, wireline 11 and cable head 15 are employed to carry an electric wireline setting tool 20 which carries a conventional firing head 21 similar to that used in setting tool 16. Setting tool 20 also carries piston 22 which moves downwardly, in the case of the apparatus of FIG. 2, in response to the detonation of explosive carried in firing head 21. The explosive is detonated by means of an electrical signal passed through wireline 11 from electric wireline unit 10 of FIG. 1. Piston 22 carries piston rod 23 which is connected directly or indirectly to a shear member 24 or connecting device such as shown in U.S. Pat. No. 5,222,554 to Blount et al. Shear member 24 is rigidly fixed to whipstock 25. Thus, when whipstock 25 is set down onto anchor 17 so that stinger 18 and orienting lug 19 mate with matching apertures and grooves in the interior of whipstock 25, it is time to separate setting tool 20 from whipstock 25. This is done by electrically actuating the explosive in firing head 21 which imparts an impact force to piston 22 which force severs shear member 24 or otherwise releases whipstock 25. Thereafter, wireline 11, cable head 15 and setting tool 20, along with piston 22 and rod 23, can be removed from the interior of casing 5, thereby leaving whipstock 25 set firmly onto packer 17. It should be understood that other tools can be used such as those in which piston 22 does not move but rather the cylinder around the piston or some other member move to effect the desired shearing action.

Figure 3:
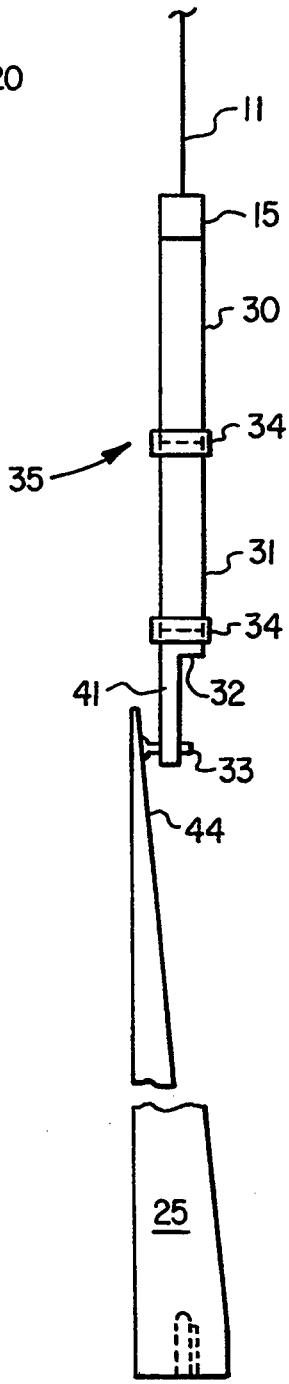
FIG. 3 shows another embodiment of setting assembly apparatus useful in this invention.

FIG. 3 shows non-electrical apparatus useful in the method of this invention which can be employed by way of wireline 11 and cable head 15 to set whipstock 25 onto packer 17. The apparatus employed in the embodiment of FIG. 3 is setting assembly 35 which is composed of accelerator tool 30, jar tool 31, setting tool 32 and shear member 33.

Accelerator tool 30 is an optional tool which is used between cable head 15 and jar tool 31 to store energy and insulate wireline 11 from the impact force generated by jar tool 31. Accordingly, accelerator tool 30 need not be employed in the apparatus of FIG. 3 but is preferred. Accelerator tool 30 is joined by means of conventional coupling 34 to mechanically or hydraulically actuated jar tool 31 which, when actuated by, for example, pulling on wireline 11, triggers the impact force from jar 31 necessary to sever shear member 33. This separates whipstock 25 from setting assembly 35. Setting tool 32 is joined by another conventional coupling 34 to jar 31.

Thus, with the apparatus of FIG. 3, whipstock 25 is set down onto anchor 17, as shown in FIG. 2, by use of setting assembly 35. Assembly 35 is removed from the interior of casing 5 after jar tool 31 severs shear member 33.

Jar tool 31 is a conventional piece of equipment which is designed, for example, to be actuated in response to a pulling force exerted on wireline 11 by unit 10 when setting assembly 35 is in the location desired in the wellbore. The jarring impact force delivered by jar 31 can be directed either up, down, or both up and down in assembly 35. Any commercially available mechanically or hydraulically actuated jar tool can be employed in this invention.

Accelerator tool 30 is also a conventional piece of apparatus currently available to those skilled in the art. It serves as an energy storage device to maximize the effectiveness of jar tool 31 and as a shock absorber to insulate wireline 11 from shock loads that may be encountered when jar tool 31 is actuated to release the whipstock and sever shear member 33. Any commercially available accelerator tool well known to those skilled in the art can be employed in this invention.

Figure 4:
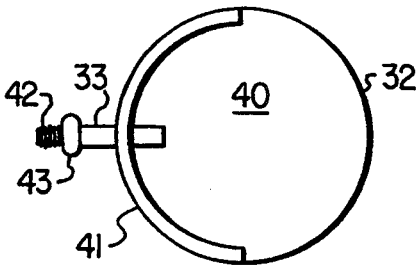
FIG. 4 shows a cross-section of the setting tool used in the apparatus of FIG. 3.

FIG. 4 shows a bottom view of setting tool 32. Setting tool 32 is essentially round in configuration, as are the other tools shown in setting assemblies 20 and 35 of FIGS. 2 and 3, and has a flat bottom portion 40 from which extends hemispherical section 41. Shear member 33 passes through and is rigidly fixed to section 41 and has an opposing shank end 42 which is threaded for engaging with a matching threaded aperture in whipstock 25. Enlarged portion 43 can be provided so as to leave a projection on the guide face 44 (FIG. 3) of whipstock 25 after shear member 33 is severed. Projection 43 can then provide the function of a wear pad or wear lug for guiding a starting mill as fully described in the aforesaid U.S. Pat. No. 5,287,921.

Figure 5:
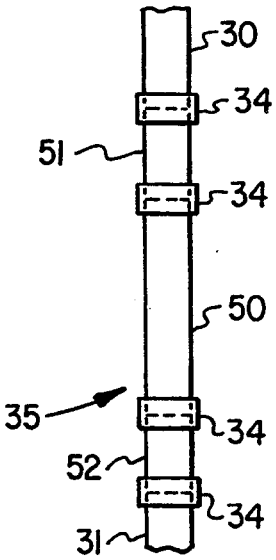
FIG. 5 shows yet another embodiment of setting assembly apparatus useful in this invention.

FIG. 5 shows setting assembly 35 with the modification that weight bar 50 is imposed between accelerator 30 and jar 31 and connected to both by means of conventional couplings 34. Weight bar 50 is optional in this invention but provides the useful function, when desired, of accentuating the impact force of jar 31 when it is actuated by wireline unit 10, thus increasing the jarring impact of jar 30 on shear member 33.

Optionally, a conventional orienting tool 51 can be carried by the setting assembly 35 of FIG. 5 or setting assembly 20 of FIG. 2. The orienting tool is used to tell the operator at the earth's surface the orientation of the whipstock while it is being set in place on packer 17.

A conventional indexing tool 52 can also be carried by setting assembly 35 or 20. This tool is used to physically rotate the whipstock and orient it in the desired direction before it is set onto packer 17. Tool 52 is also optional.

The apparatus of this invention can be employed inside any well conduit in a wellbore and can be run through tubing that is already in place inside casing such as casing 5. In the case of through tubing operations the tubing can end intermediate the length of the casing so that the anchor packer and whipstock can be passed through the tubing and then set inside the casing below where the tubing ends.

Reasonable variations and modifications are possible within the scope of this disclosure without departing from the spirit and scope of this invention.

What is claimed is:

1. In a method for setting a whipstock in a wellbore that extends into the earth from the earth's surface wherein a packer-anchor is first set in said wellbore and said whipstock is thereafter set onto said packer anchor, the improvement comprising providing a wireline unit at the earth's surface having a supply of wireline, said wireline carrying at a first end a setting assembly, said setting assembly carrying a shear member, said shear member being connected to said whipstock, passing said first end of said wireline with said setting assembly-whipstock combination into said wellbore until said whipstock mates with said packer-anchor, actuating said setting assembly to provide an impact force to sever said shear member, and removing said wireline and setting assembly from said wellbore thereby leaving said whipstock set onto said packer anchor.

2. The method set forth in claim 1 wherein:

said setting assembly is electrically accuated and is composed of an electric wireline setting tool that carries a firing head containing an explosive that is electrically actuated and a member that moves in response to actuation of said explosive, said member acting upon said shear member.

3. The method set forth in claim 1 wherein:

said setting assembly is composed of a jar tool.

4. The method set forth in claim 3 wherein:

said wireline carries an accelerator tool between said first end and said jar tool to store energy and insulate said wireline from the impact force generated by said jar tool.

5. The method set forth in claim 3 wherein:

said wireline carries at least one weight bar adjacent said jar tool to accentuate the jarring impact of said jar tool.

6. The method set forth in claim 1 wherein:

said setting assembly carries at least one of an orienting tool and an indexing tool.

* * * * *